United States Patent [19]

Prange

[11] Patent Number: 4,839,936

[45] Date of Patent: Jun. 20, 1989

[54] AUTOMATED SEWER CLEANING RODDING MACHINE

[75] Inventor: Charles J. Prange, Cridersville, Ohio

[73] Assignee: Sewer Rodding Equipment Company, Lima, Ohio

[21] Appl. No.: 191,583

[22] Filed: May 10, 1988

Related U.S. Application Data

[63] Continuation-in-part of Ser. No. 128,460, Dec. 3, 1987.

[51] Int. Cl.[4] ..... B08B 9/02

[52] U.S. Cl. ..... 15/104.33; 175/27

[58] Field of Search ..... 15/104.33; 254/134, 254/319; 175/27

[56] References Cited

U.S. PATENT DOCUMENTS 3,176,335 4/1965 Ciaccio et al. ..... 15/104.33
3,399,417 9/1968 Hammond et al. ..... 15/104.33
3,464,076 9/1969 Ciaccio ..... 15/104.33
4,503,918 3/1985 Bergkvist et al. ..... 175/27

*Primary Examiner*—Edward L. Roberts
*Attorney, Agent, or Firm*—David O'Reilly

[57] ABSTRACT

An automatic sewer rodding machine having a carriage mounted storage reel rotatably driven by a hydraulic drive. A rod feed system also mounted on the carriage has a hydraulic drive to feed sewer cleaning rod out and back. An automatic rod feed reversing system senses resistance to rod movement and automatically reverses rod travel for a predetermined time period. After the period times out rod travel is restored to normal operation. The automatic reversing system continuously cycles the sewer cleaning rod into an obstruction in a sewer line until it is cleared. Switch selection of normal or reverse automatic rod feed or entirely manual operation is provided.

12 Claims, 5 Drawing Sheets

AUTOMATED SEWER CLEANING RODDING MACHINE

CROSS REFERENCE TO RELATED APPLICATION

This Application is a Continuation-in-Part of Application Ser. No. 128,460, filed Dec. 3, 1987.

FIELD OF THE INVENTION

This invention relates to sewer cleaning equipment and more particularly relates to an automatic sewer cleaning rodding machine.

BACKGROUND OF THE INVENTION

Sewer cleaning rodding machines have a rod holding reel mounted on a carriage and a rod feed unit mounted for rotation with the reel. The rod feeding system is driven by a hydraulic motor mounted on and turning with the entire reel mounting carriage. The carriage is independently rotated by a hydraulic motor mounted on a main support frame. Such systems are known and described in U.S. Pat. No. 3,176,335 and U.S. Pat. No. 3,393,415 incorporated herein by reference. These patents disclose such a machine and also disclose a reel arrangement for storing and feeding rod to the rod feeding system.

The rotatably mounted reel provides storage for the cleaning rod when not in use and imparts rod rotation by rotation of the carriage it is mounted on. A variety of sewer tools may be mounted on the end of the sewer cleaning rod which is fed into a sewer to clear obstructions from blocked or clogged sanitary, storm or sewer lines. In present systems experienced rod operator personnel are required and are hard to find. Because the operative events occur in a conduit well beneath the surface, and invariably far from the operator, it takes a good deal of experience before operators can determine how much pressure can be applied to the sewer cleaning rod without resulting in breakage or damage to tools attached to the rod and even injury to personnel. This is because he is so far from the operative situation. Even with experienced personnel, losses due to down time, tool damage, broken rods and personal injury are ever-present risks.

In some cases sewer cleaning machines are operated in the reverse mode. The sewer rod is passed through a blockage and a cutter tool attached to the rod. The blockage is then cleared by drawing the rod toward the machine until the debris is cleared. This method may be prefered when the blockage is upstream from the machine.

Therefore an object of the present invention is freeing the process of the removal of obstructions from blocked and clogged sanitary systems from the judgment of the operators. It provides a substantially sure-and-simple operation that eliminates the need for experienced sewer cleaning machine operators. The machine supplies the equivalence of experience.

Another object of the present invention is to provide a sewer cleaning rodding machine for dislodging roots, debris and other stoppages causing material easier, faster and more economically. This object is achieved through an automatic sewer rod feeding concept which increases efficiency, improves performance and substantially eliminates operator error.

Yet another object of the present invention is to provide an automatic sewer cleaning rodding machine which will automatically advance the rod at a suitable rate up to some predetermined resistance. The system automatically retracts the rod when the predetermined resistance occurs. This resistance may be occasioned by an excessive resistance to advancement of the rod.

Still another object of the present invention is to provide a system to select predetermined rod forces and speed which are locked to prevent tampering by inexperienced or unauthorized personnel.

Yet another object of the present invention is to provide an automatic sewer rodding machine which automatically reverses rod travel when some obstruction excessively resistes the forward movement of the tool. The tool is rapidly retracted to a preset limit; then rod forward travel is again automatically reversed to direct the tool back into the stoppage and this procedure is repeated until the obstruction is dislodged and the tool moves to the next obstruction or blockage.

Another object of the present invention is to provide a machine in which the primary hydraulic rod feed operational mode is reversible. This permits operation in a withdrawing mode to clear debris blocking a sewer upstream by drawing a cutting tool toward the machine from beyond the blockage until it is dislodged and washed away.

BRIEF DESCRIPTION OF THE INVENTION

The purpose of the present invention is to provide a sewer cleaning rodding machine which will automatically feed sewer cleaning rod and tool attached thereto at a predetermined rod travel speed and force. The machine will automatically retract the rod when an obstruction slows movement causing an increase in fluid pressure above a predetermined amount.

The above objects of the invention are achieved with a electro-hydraulic control system which can be preset to control the rod travel speed and force applied. Adjustable pressure control devices with a key locking dial allow the device to be set for predetermined rod pressures, rod travel speed and direction which can not be changed without unlocking the key locked dial. The easy adjustability of the electro-hydraulic system permits compensation for the condition of a sewer line and the choice of tool to be made. The automatic rodding system permits the selection of a wide range of performance characteristics to suit the individual situation. The automatic sewer cleaning rodding machine when set and locked by an experienced supervisory operator will wade into heavy removal of accumulations of root and other debris almost without attention, reducing the blockage to a shredded mass that will wash harmlessly down the sewer line.

The automatic sewer rodding machine has manual hydraulic level operated valves which allow the operator to manually reverse either or both the rod rotation and direction of travel of the rod. Coupled to these valves is a pressure sensing switch and a timing system which senses the pressure being applied to move the rod. When the pressure reaches a predetermined limit the pressure sensitive switch causes hydraulic flow to a rod advancing hydraulic motor to be reversed by activating an electrically operated spool valve retracting the rod. A preset and locked timer will retract the rod for a distance determined by the time set on the timer. When the pressure sensitive switch opens the timer starts counting. At the end of the timing period the timer deactivates the electrically operated spool valve to again reverse the direction of travel of the rod to send the rod back into the blockage. This process is repeated until the blockage is cleared.

The machine also includes a system to completely reverse the machine rod feed hydraulics to change the primary mode of operation. This system uses a solenoid operated hydraulic shuttle valve activated by an electric switch on the operating panel. The electric switch activates the solenoid to reverse the hydraulic shuttle valve to reverse hydraulic flow to a rotary union and also to the rod feed drive.

The rotation rate of the rod storage reel and carriage as well as the rate of travel of the rod itself are controlled by easily adjusted, hydraulic valves. Valves automatically controlling rod reversal are mounted beneath a padlocked cover to prevent tampering and unauthorized changes of the settings. The system can be mounted on a truck chassis or on a trailer.

The simple, easy, to use tamper proof operation removes time and money wasting sewer line stoppages automatically with minimum operator intervention. As equipped the sewer rodding machine can be more productive and economical in operation. Further the automatic operation results in longer rod and tool life with less possibility of loss due to tool and rod damage and down time as well as reducing or eliminating the potential of personal injury.

The above objects, advantages and novel features of the invention will be more fully understood from the following detailed description and the accompanying drawings in which like reference numbers indicate like parts throughout:

DETAILED DESCRIPTION OF THE INVENTION

Figure 1:
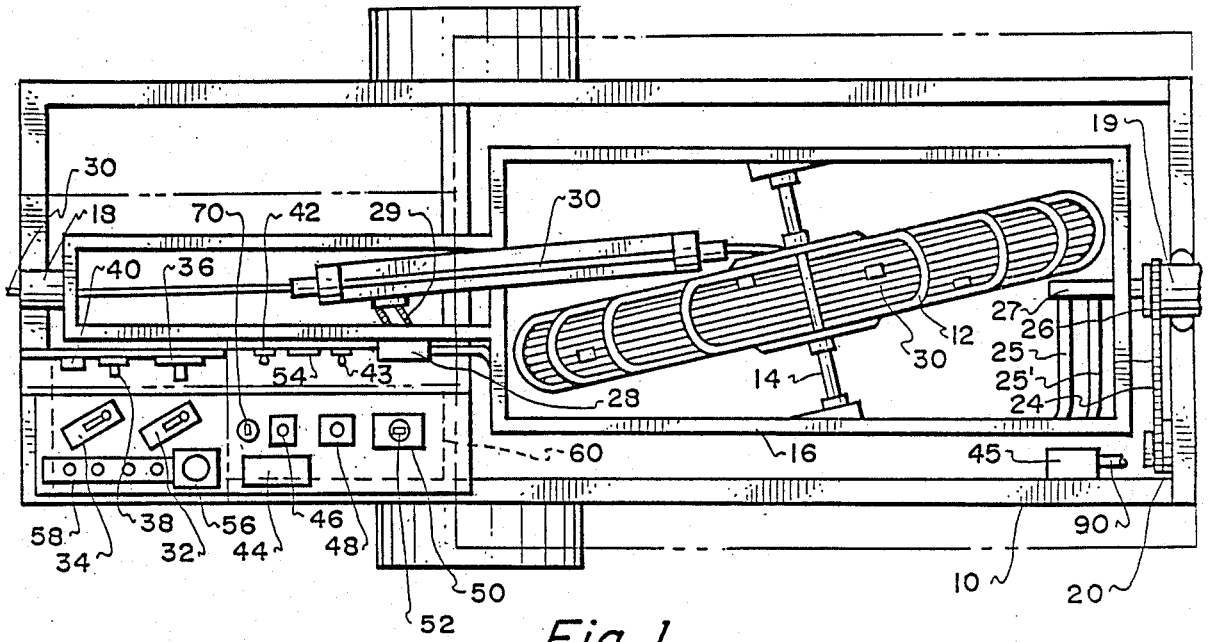
FIG. 1 is a top elevation plan view of a reversible automatic sewer rodding cleaning machine according to the invention with the outer structure shown in phantom for clarity.
Figure 2:
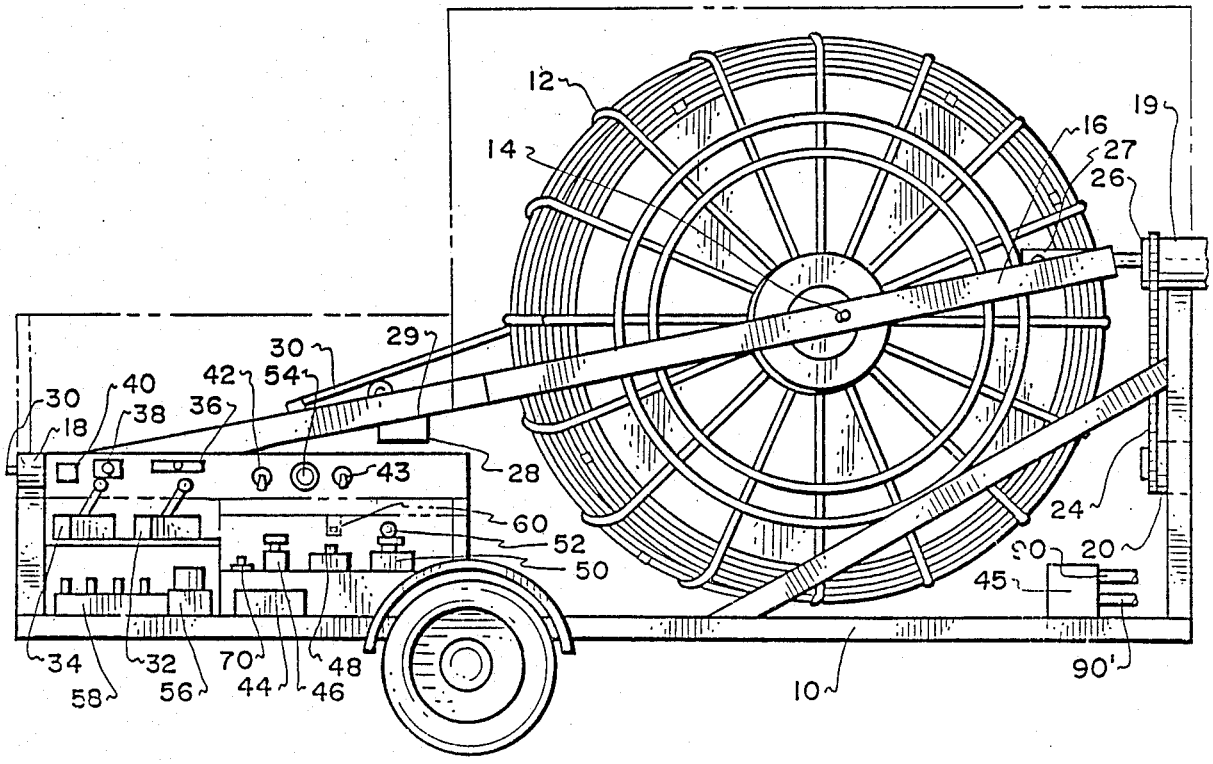
FIG. 2 is a side elevation of the reversible automatic sewer rod cleaning machine according to FIG. 1.

An automatic sewer rod cleaning system is illustrated in FIG. 1 and 2 which will operate substantially free of control of an experienced operator. The system utilizes a "memory" to automatically remove troublesome roots and debris from sewer lines by safe, automatic operation. Referring to FIG. 1 a automatic sewer rod cleaning machine having a chassis 10 for mounting on a trailer or truck is shown. The outer structure is shown only in phantom for clarity. Rod storage reel 12 is rotatable mounted an axle 14 supported by a carriage 16 which itself is rotatable mounted in bearings 18 and 19 at each end of the carriage. Carriage 16 is rotated by a motor 20 driving chain 24 linked to gear 26.

A rod feed system is provided by a second hydraulic drive motor 28 connected by chain 29 to drive feed rollers (not shown) to feed rod 30 from rotatable reel 12. Sewer cleaning rod 30 is simultaneously fed or returned to storage reel 12 by drive motor 28 while carriage 16 is being rotated by carriage drive motor 20. Such a system is disclosed and described in U.S. Pat. Nos. 3,176,335 and 3,393,415 incorporated herein by reference.

For use in cleaning sewer lines a cleaning tool (not shown) such as a root cutter or other tool is mounted on the end of sewer cleaning rod 30 and fed into a sewer line. The tool is advanced by the rod feed motor 28 while being rotated by rotation of carriage 16. While these systems are very effective for cleaning sewers a frequent problem is the breaking of tools and rods due to excessive pressure applied by an operator.

To solve these problems a automatic rod feed system is provided to automatically control the rate of feed of the sewer cleaning rod 30 as well as the force applied to the sewer cleaning tool. Periodically, in removing sewer line blockages, when the force on the tool reaches a predetermined pressure the system automatically retracts the tool a predetermined timed distance, reverses the rod travel direction with the tool again cutting into the blockage to remove it. The system provides smooth effortless cleaning with the operator only providing initial activation and advancement of the sewer cleaning rod and tool. From that time on operation is entirely automatic until the blockage is clear or the operator either stops the system and retracts the tool. Additionally the system provides for normal manual operation under certain circumstances such as when a particularly troublesome blockage is encountered and more operator control is needed.

The automatic rod advancing system illustrated in FIGS. 1 and 2 has carriage rotation direction manual lever operated valve 32 and rod direction travel manual lever operated valve 34. Valve lever positions provide manual selection of forward, reverse and neutral (off) center positions. Carriage rotation direction lever manually operated valve 32 controls the rotational operation of hydraulic motor 20 to control the directional rotation of the carriage 16 which in turn rotates sewer cleaning rod 30. Carriage rotation direction valve 32 provides right hand, left hand or no carriage rotation.

Rod direction travel manual lever operated valve 34 controls the direction of feed of sewer cleaning rod 30 from storage on reel 12. Either continuous or sectional rod may be used with the former being preferred. Rotary union 19 permits hydraulic fluid transfer from stationary lines to rotating fluid line delivering hydraulic fluid through fitting 27 to rod direction motor 28 allowing manual selection of automatic operation in either the forward or reverse direction with the arrangement shown. That is, automatic operation in either an advancing mode or rod retraction mode may be made by reversing manually the lever on valve 34. The latter means when the sewer cleaning rod is being drawn back through a blockage in a sewer line.

A system is also provided to select rod feed reverse hydraulic operation as the primary mode. This system reverses the machine hydraulics to reverse automatic hydraulic operation. This system allows the tool to be automatically drawn back (i.e. advanced) through a blockage of debris until the predetermined pressure (i.e. resistance) is reached and then rod feed direction is reversed to extend (i.e. retract) advance the rod a predetermined timed distance. Operation is again automatically reversed and the tool advanced into a blockage by withdrawing the sewer cleaning rod again.

Carriage/reel, rotation force, rod pressure force and rod speed are all adjustably controlled. Valve 36 is an adjustable needle valve which controls line pressure and thus carriage rotation force. Rod pressure is controlled by adjusting valve 38, and rod speed is controlled by adjusting rod speed control valve 40.

Automatic or manual operation is selected with toggle switch 42 which activates the operation of robotic control valve module 44, reverse travel speed control valve 46, recycle timer 48 and hydraulic rod pressure sensing switch 50. The hydraulic pressure sensing switch 50 adjustment is locked in its preset position with a key 52 to prevent tampering. Rod pressure gauge 54 shows the adjusted pressure. Hydraulic fluid is recirculated through manifold 58 and filtered by the oil filter 56. In addition to the tamper proof protection provided by locking pressure sensing switch 50 a padlocked cover 60 (shown in phantom) is provided to prevent tampering and unauthorized change of the initial settings for automatic operation. Manual operation is unaffected. Manual/automatic select toggle switch 42 and reel and rod manual adjustments are still available to the operator. However, adjustments made for automatic operation once set are secured from tampering or change.

The reverse rod feed mode might be selected when operating on a blockage of debris upstream form the sewer cleaning machine or when the cutting tool punches through a blockage without clearing it. In either case reverse operation as the primary mode is selected by activating electric toggle switch 43 to operate solenoid activated hydraulic control 45. Hydraulic control valve 45 may be a four-way, two-position, spool valve, direct acting, solenoid operated, catridge type, hydraulic direction control valve manufacted by Modular Controls Company as Model No. SV1-16-4-6-12D-L or the like.

Rod feed reverse operation as the primary mode is selected with toggle switch 43 which activates four-way solenoid activated hydraulic valve 45 to reverse the flow of hydraulic fluid through lines 90 and 90' to rotary union 19, hydraulic fitting 27, and lines 25,25' reversing operation of rod feed drive motor 28.

The sewer rod cleaning machine hydraulic system is shown in semi-schematic form if FIGS. 4*a* through 4*f* in which like reference numbers indicate like parts through out. The system can be operated automatically (robotically) in normal or reverse mode or manually with carriage/reel rotation operated in right hand, left hand or no rotation modes independent of the selection of automatic or manual rod feed drive selection. Two directions of rotation or no rotation can be selected.

Figure 4A:
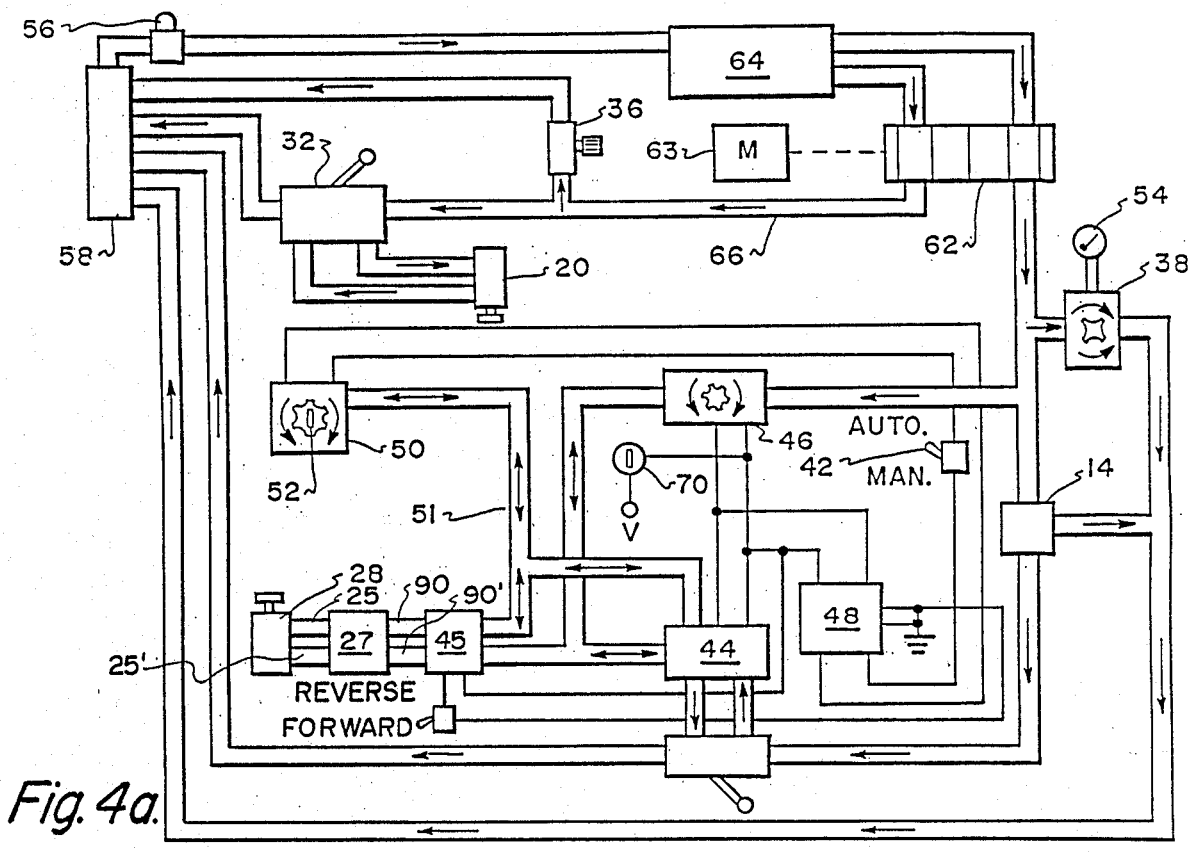
FIG. 4*a* through 4*f* are schematic hydraulic diagrams of the automatic sewer rod cleaning system illustrating operation in normal, reverse and manual modes.
Figure 4B:
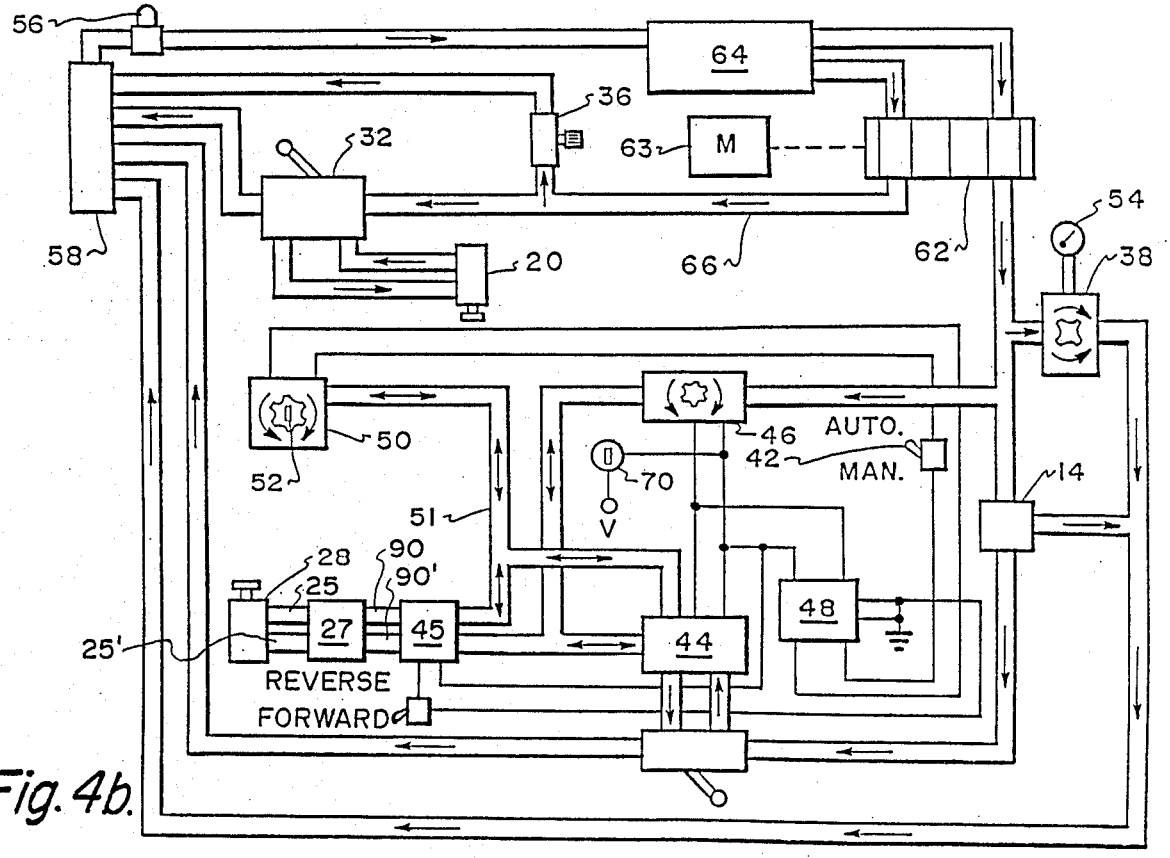
Figure 4C:
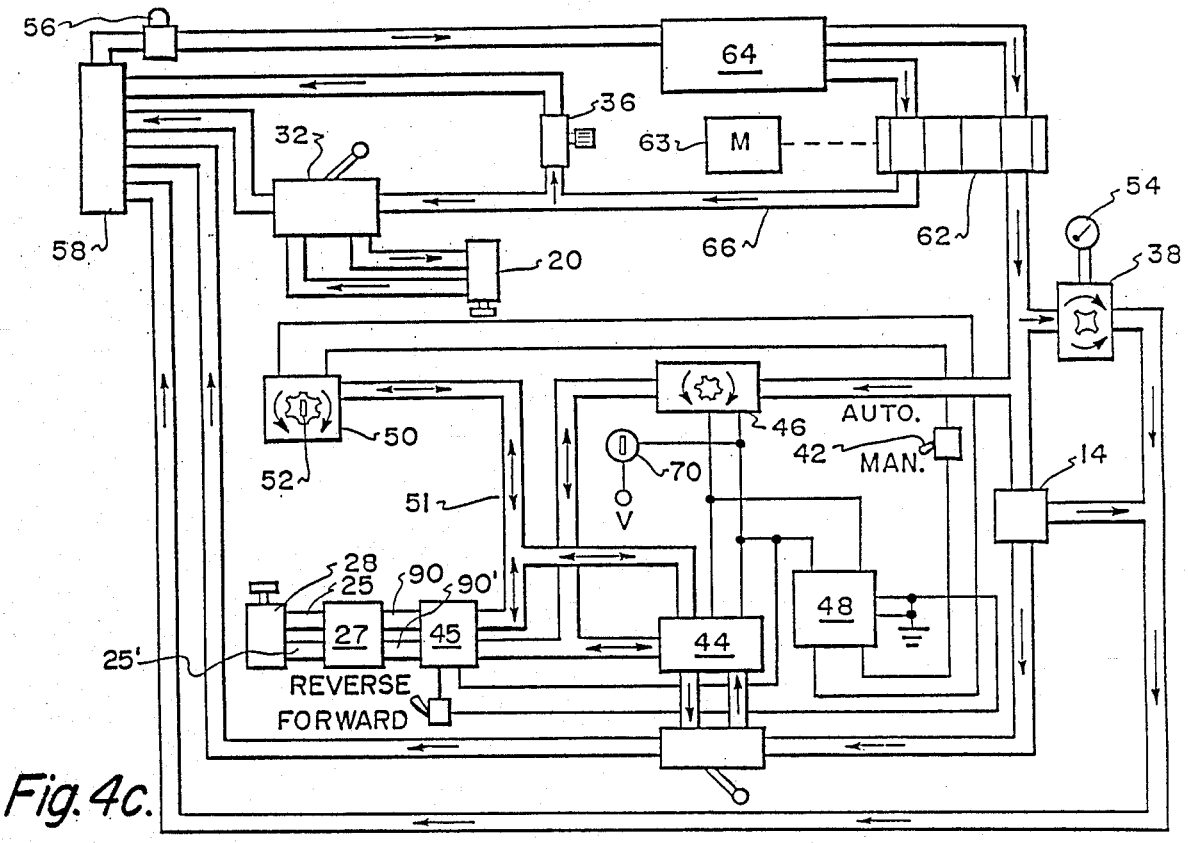
Figure 4D:
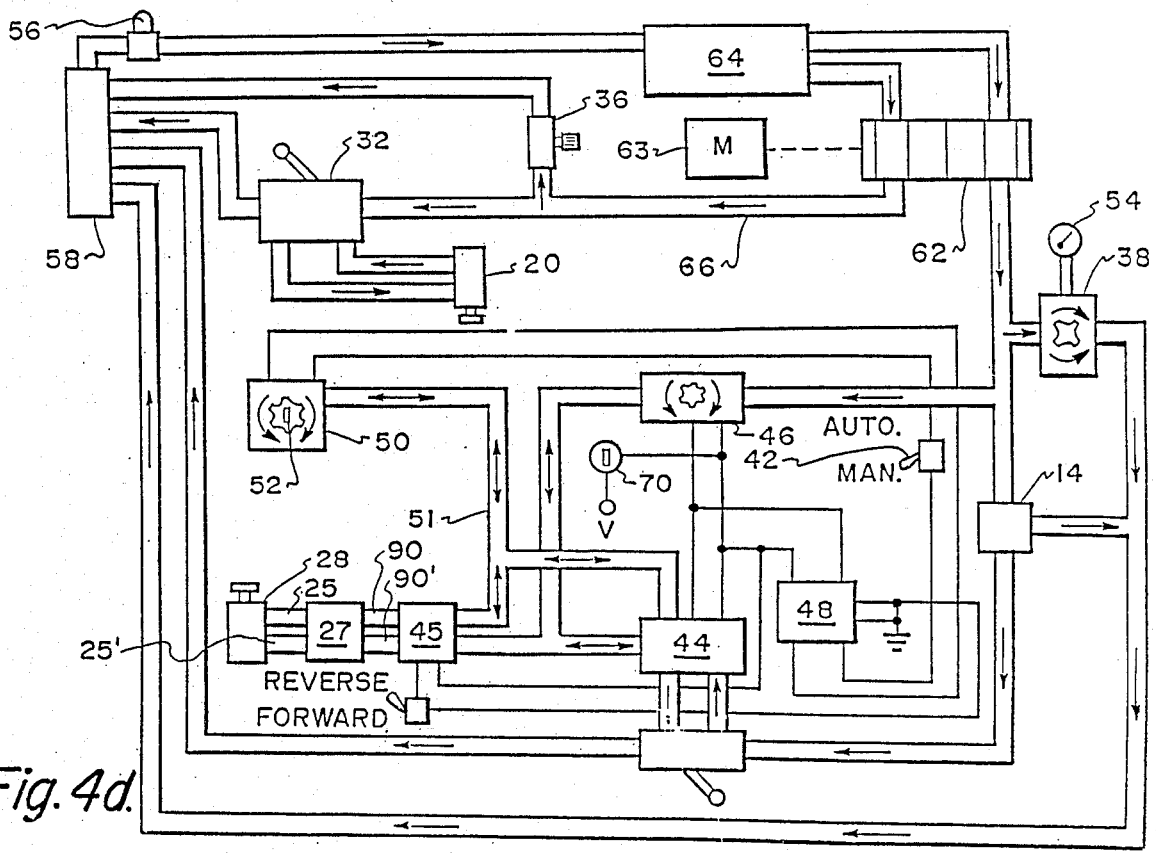

The rod feed system can be in normal or reverse automatic mode or manual mode with rod travel direction being advance, retract or off. FIGS. 4*a* and 4*b* illustrate system operation in the normal automatic mode. In these figures carriage rotation select valve 32 is set for right hand rotation with rod direction valve 34 set to feed rod out. Carriage/reel rotation hydraulic motor 20 rotates the carriage in the direction selected by the position of manually operated lever on valve 32 while the manually operated lever on rod feed valve 34 selects rod direction by controlling operation of rod feed hydraulic motor 28.

A dual drive hydraulic oil pump 62 driven by motor 63 delivers hydraulic fluid from reservoir 64 to simultaneously drive the rod feed system and carriage rotation system. Arrows indicate the flow of the hydraulic fluid through respective conduits. Conduit 66 leads to carriage rotation lever valve 32 which controls the flow to and from carriage drive motor 20. Reel rotation force and hence rod rotation is controlled by adjusting valve 36 to control the flow rate of hydraulic fluid through conduit 66 to carriage drive hydraulic motor 20. Rod rotation direction is controlled by moving the lever on carriage (rod) rotation direction valve 32. Moving the lever on rotation valve 32 (FIG. 3*a*), to the left reverses the flow of hydraulic fluid to reel rotation motor 20 thus reversing rotation of the carriage/reel and hence the rod rotation. No rotation is selected by moving the lever to a center neutral position. Right hand rotation, left hand rotation or no rotation can be selected independently of automatic operation the rod feed system.

Rod feeding is controlled by rod feed direction lever valve 34, adjustable rod pressure force valve 38 and rod speed control valve 14. Rod speed control valve 14 limits the speed at which sewer cleaning rod 30 can be advanced (or retracted) through a blockage.

Manual or Automatic rod feed is selected by toggle switch 42, and controlled by modular rod direction control valve 44, adjustable reverse rod travel speed valve 46, recycle timer 48, hydraulic pressure sensing switch 50 and includes rotary union 19. The latter components affect the rod feeding and drive system only when toggle switch 42 is in the automatic position.

When automatic operation is selected, pressure sensing switch 50 is in the circuit with timer 48. When advancing rod 30 and the pressure in conduit 51 reaches the pressure set in switch 50 the circuit is closed activating timer 48 which is a "delay on break" time delay relay; this in turn activates reverse rod travel speed adjustable valve 46, bypassing rod speed control 14, and automatic travel modular control 44. Upon activation modular control spool valve 44 reverses the flow of hydraulic fluid to rotary union 19 and rod feed direction motor 28 as shown in FIG. 3*b*. This causes the rod to be retracted or withdrawn at a higher rate of speed for a period of time selected by recycle timer 48. When recycle timer 48 times out time delay relay closes and modular control valve 44 is deactivated along with rod speed adjusting valve 46 which is closed. This again reverses flow to rotary union 19 and rod drive motor 28 feeding rod out from the storage reel at the normal rate controlled by speed control valve 14. The process is continuous as the rod feed system will continuously recycle the rod feed unit as long as the rod direction travel lever valve 34 is in the position shown in FIG. 3*a* and 3*b*.

Automatic operation is possible with the carriage/reel rotation directional lever valve 32 in a neutral or reversed position for no or reversed rod rotation with toggle switch 42 still in the auto position. As before the rod will be fed into the sewer line until a blockage is encountered. Pressure builds up in conduit 51 until hydraulic rod pressure sensing switch 50 closes activating timer 48 reversing rod direction to retract the rod. After "timing out" timer 48 resets the rod feed again begins feeding rod into blockage restoring normal forward operation. Automatic operation can be selected with rod direction valve in either forward or back (retract) position.

Reverse automatic mode of operation is selected by changing normal or reverse toggle switch 43 to reverse. This causes hydraulic direction control valve 45 to reverse the flow of hydraulic fluid through lines 90,90', rotary union 19, fitting 27, hydraulic lines 25,25' to rod feed drive motor 28. The operation of the machine is substantially the same as described previously with respect to the normal mode of operation except that rod feed travel is reversed. Rod feed into a blockage is now toward the machine while retraction (i.e. extension) of the rod and tool is away from the machine allowing an attack an a blockage from downstream by passing the rod through and beyond the blockage. Timer 48 and pressure sensing switch 50 remain in the circuit in the reverse mode.

Figure 4E:
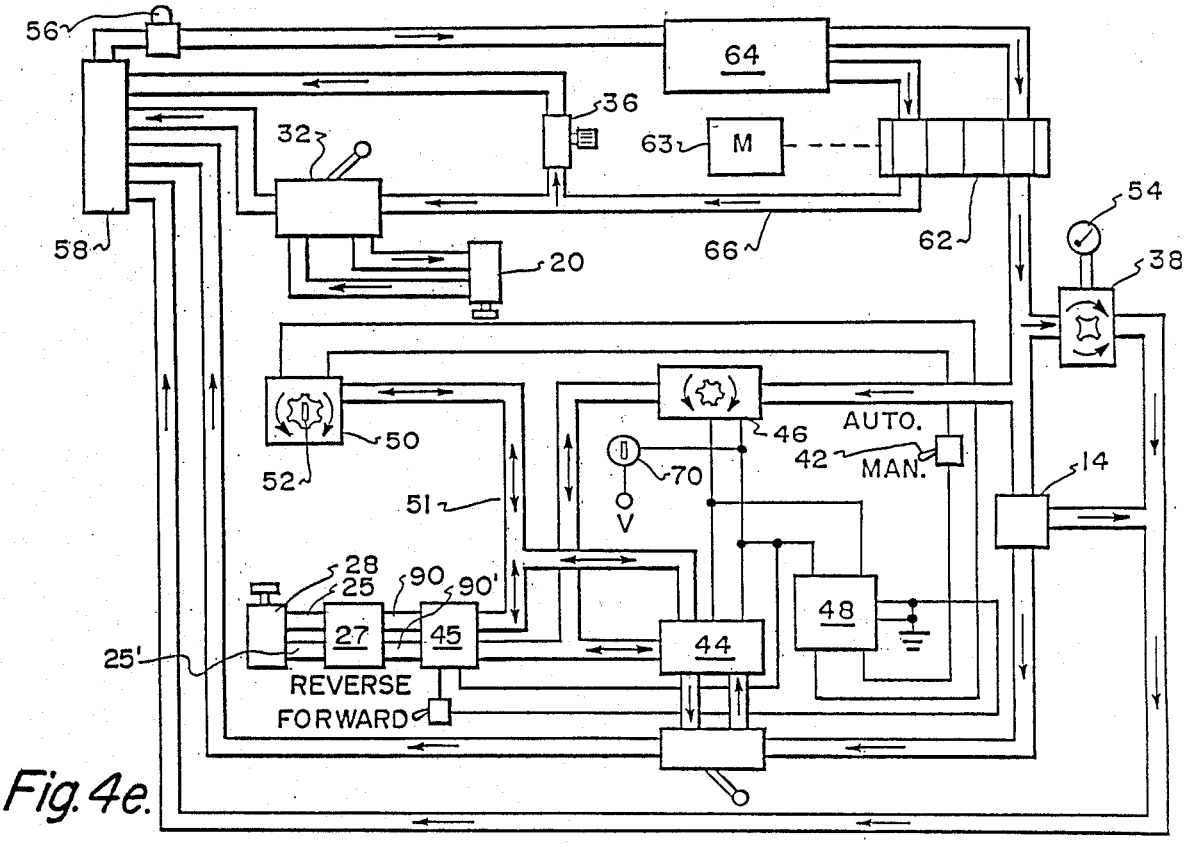
Figure 4F:
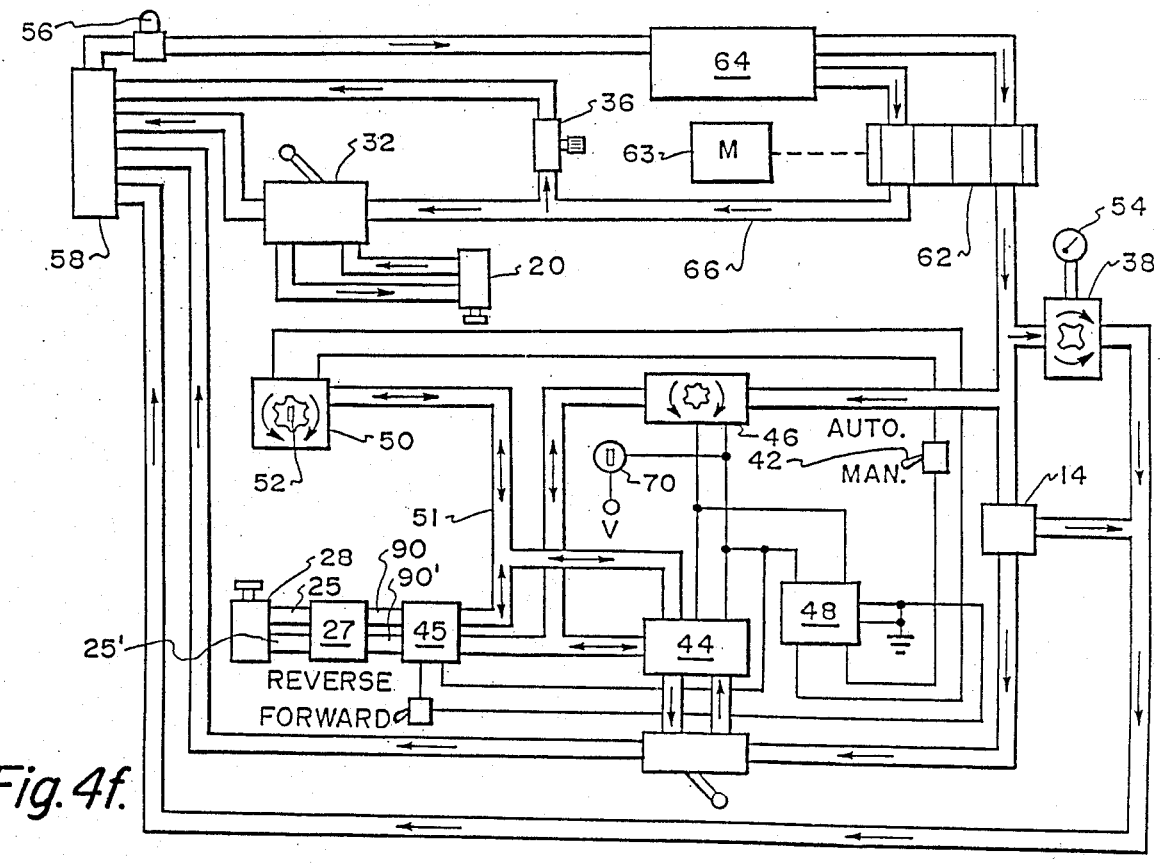

Manual modes of operation are illustrated in FIGS. 4*e* and 4*f*. FIGS. 4*e* shows rod direction travel lever valve 34 set for the forward or feed out position with carriage/reel rotation lever valve 32 selecting carriage rotation as previously described. Toggle switch 42 is now in the manual position with timer 48 and pressure sensing switch 50 out of the circuit and normal/reverse switch 43 in normal position but it may be in either position. Valves 44 and 46 are now in a steady state position.

Figure 3:
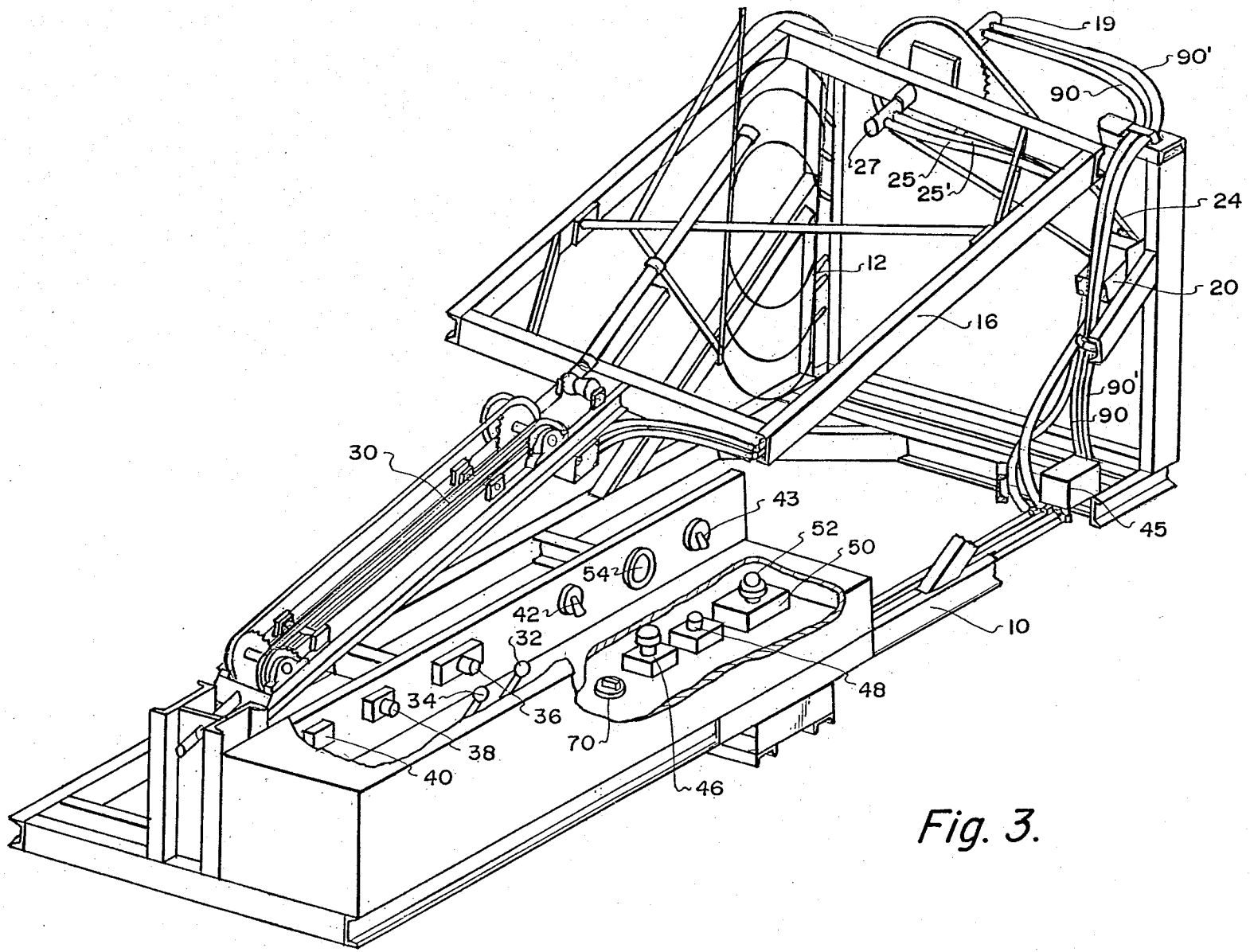
FIG. 3 is a perspective skeletal view of the reversible automatic sewer rodding machine with portions of the external structure omitted for clarity.

Manual reversal of rod feed direction is achieved by moving the lever on rod direction valve 34 to the opposite position shown in FIG. 3(*d*). Manual operation is as previously described by independently controlling operation of carriage/reel rotation and while simultaneously controlling the direction of rod travel. Of course the various adjustable valves adjust the force and travel speed of the rod and the carriage rotation in manual mode as well.

Automatic operation is selected by turning on ignition switch 70 to apply voltage from a battery (not shown) to valves 44, 45 and 46 and time delay relay recycle timer 48. At this time valve 46 is closed and valve 44 is set for normal rod direction selection by valve 34. Normal or reverse automatic operation selected by switch 45 is controlled by setting the sensitivity at which pressure signal switch 50 will activate recycle timer 48, and valves 44 and 46. Recycle timer 48 is set for the amount of time (i.e. distance) of reverse travel of the rod before returning to an original direction of travel. Rod reverse speed is also set by adjustment of electrically controlled valve 46 which bypasses rod speed valve 14 during automatic reversal operation.

After switch 70 is turned on, and adjustments of pressure switch and timer made according to the type of sewer line, anticipated blockage tool to be used etc. and normal or reverse operation are selected by an experienced operator pressure sensing switch 50 is locked and the cover providing access to these components is closed and padlocked. This prevents tampering with the settings by the operator and allows almost complete unattened, automatic operation. When the pressure in conduit 51 reaches the pressure set by Bourden tube pressure signal switch 50 the switch closes activating timer 48, reversing rod direction control spool valve 44 and opening adjustable reverse speed valve 46. Flow is then reversed to rod feed drive motor 28 rapidly retracting the rod for the period of time set in the timer 48. When the preset cycle of the timer is reached valve 46 is closed and modular control spool valve 44 is reversed again reversing rod direction into the sewer line blockage. This process in continuously and automatically repeated until the blockage is cleared.

The following component part numbers for the automatic rod feed system are given only by way of example. Recycle timer 48 is a "delay on break" time delay relay in which voltage is applied to the timer at all times through ignition switch 70 which is also applied to modular control spool valve 44 and speed valve 46. Upon closure of normally open pressure signal switch 50 timer 48 opens and remains in the open or break position for the period adjusted by the adjustable timer. Pressure in conduit 51 will begin to drop opening pressure signal switch 50 before the end of the preset time delay. Time delay relay 48 then closes returning (i.e. reversing) operation back to normal to begin a new cycle.

Reverse travel speed valve 46 is a normally open valve similar to that manufactured and produced by Modular Control Co., model no. SV1-10-C. This valve is a two way normally open, poppet type, solenoid activated, directional control valve. With power applied through ignition switch 70 to valve 46 it is in a closed position. When pressure sensing switch 50 is activated closing recycle timer 48 power is removed and the valve opens allowing hydraulic fluid to bypass speed valve 14 to rapidly retract the rod.

Pressure sensing switch 50 can be a switch manufactured and sold by Rexroth Co., model HED2 or equivalent. This switch is a hydro-electric pressure switch which opens or closes to switch an electrical circuit on or off depending upon pressure applied to the switch. Pressure is sensed and acts on a Bourden tube causing an operating lever to transmit movement of the bourden tube to a microswitch. The electrical swich is turned on when a pre-determined pressure is achieved. Switching pressure is adjusted externally by means of a lockable hand adjustable knob. Once adjustment has been made and the hand knob locked with the key no further adjustments can be made without unlocking the hand knob.

The rod force adjusting valve 38 is a hydraulic needle valve having an adjustable hand control manufactured and sold by Modular Control Co. as model number NV1-10. Rod force (i.e. pressure applied) is adjustably controlled by this valve.

Reversing spool valves 44 and 45 are fourway, two position, spool type, direct acting, solenoid operated, hydraulic control valves. A suitable two position solenoid operated spool valve for this purpose is manufactured by Modular Controls under model no. SV1-4. A voltage is applied through ignition switch 70 to the valve to control the flow from rod direction valve 34 as selected. When pressure signal switch 50 is activated by pressure in conduit 51 the voltage is removed and the valve reverses flow to retract the rod. When the timer times out the time delay relay closes allowing voltage to be again applied the valve to again reverse flow. Thus, the modular control valve reverses the flow selected by rod direction lever valve 34.

With the arrangement described automatic operation can be selected with valve 34 in the forward (i.e. in) position or the reversed (i.e. out) position to automatically clear a blockage while advancing or retrieving a cutting tool attached to the rod. The latter mode is particularly useful where the rod and tool may "punch" through a stoppage without completely clearing it. Operation in a rod retrieval mode can be done by moving manual lever on valve 34 to the retract position. Alternatively, reverse operation as the primary automatic mode can be selected with normal/ reverse switch 43. With toggle switch 43 selecting reverse rod operation the rod may be driven into a stoppage until switch 50 senses too much pressure causing the system to reverse extending (i.e. retracting) the rod beyond the stoppage until again reversed. Again this operation will continue automically until the blockage is clear.

Thus there has been disclosed a sewer rodding machine which operates in a multiplicity of normal, reverse automatic modes or manual mode. The normal or reverse automatic modes are adjustable and lockable to prevent tampering with the control settings. In the automatic mode rod direction travel is selectively controlled in forward or reverse direction of operation.

This invention is not to be limited by the embodiment shown in the drawing and described in the description which is given by way of example and not of limitation but only in accordance with the scope of the appended claims. .pa

I claim:

1. A sewer rodding cleaning machine comprising:
a chassis frame;
a rotatable carriage mounted on said frame;
a rod storage reel rotatably mounted on said rotatable carriage;
carriage drive means for rotating said carriage;
said carriage drive means including rotation selection control means;
rod feed drive means for feeding rod into a sewer line:
said rod feed drive means including rod feed direction selecting control means for selectively feeding said rod out or back;
sensing means sensing resistance to movement of said rod:
rod travel reversing means for reversing rod travel;
said sensing means activating said rod travel reversing means;
said rod travel reversing means reversing the direction of travel of said rod for a predetermined distance;
rod feed restoring means for restoring rod travel to the original direction after said rod has traveled said predetermined distance;
rod direction selection control means for reversing the normal operation of said rod feed drive means from feeding rod out and reversing to feed rod back to feeding rod back to reversing to feed rod out;
whereby said rod may be cyclically moved into and out of a sewer line blockage until said blockage is cleared.

2. The machine according to claim 1 in which said rod feed drive means is a hydraulic drive means and includes a lever operated hydraulic valve for selectively moving said rod out or back.

3. The machine according to claim 2 in which said sensing means comprises a pressure sensitive switch sensing the pressure of hydraulic fluid flowing through said rod feed hydraulic drive means; said pressure sensitive switch being activated when said hydraulic fluid reaches a predetermined pressure.

4. The machine according to claim 3 in which the predetermined pressure at which said pressure sensitive switch is activated is adjustable.

5. The machine according to claim 4 in which said pressure sensitive switch includes locking means for locking said switch after adjustment of said pressure sensitivity.

6. The machine according to claim 5 in which said rod travel reversing means for reversing the direction of travel of said rod includes;
electrically operated spool valve means for reversing the flow of hydraulic fluid to said rod feed hydraulic drive means; and
recycle timing means for returning said spool valve to normal hydraulic fluid flow after a predetermined timer by deactivating said electrically operated spool valve.

7. The machine according to claim 1 including;
a rod speed valve for controlling the rate of travel of said rod;
an electrically operated reverse speed bypass valve bypassing said rod speed valve when said rod travel is reversed for increasing the reverse rod travel speed;
said electrically operated rod speed valve being activated by said pressure sensitive switch.

8. The machine according to claim 7 in which said electrically operated reverse speed bypass valve is adjustable whereby the reverse rod travel rate may be varied.

9. The machine according to claim 1 in which said rod feed restoring means includes switch means for selectively switching from manual to automatic operation or back.

10. The machine according to claim 9 in which said rod feed restoring means includes means for automatically restoring rod feed travel after said rod travels in a reverse direction said predetermined distance.

11. The machine according to claim 1 in which said rod direction selection means comprises;
rod direction control means for reversing normal rod direction travel to reverse direction of travel;
switch means for activating said rod direction control means to selectively switch from normal to reverse rod travel direction.

12. The machine according to claim 11 in which said rod direction control means comprises;
a solenoid activated hydraulic flow direction control valve.

* * * * *